US006145800A

United States Patent [19]

Watkins

[11] Patent Number: 6,145,800

[45] Date of Patent: Nov. 14, 2000

[54] COLLAPSIBLE PORTABLE WORK SUPPORT

[76] Inventor: Ronald Eugene Watkins, 223 Pioneer Drive, Unit C-24, Kitchener, Ontario, Canada, N2P 1L9

[21] Appl. No.: 09/126,219

[22] Filed: Jul. 30, 1998

[51] Int. Cl.[7] ..... A47B 97/04

[52] U.S. Cl. ..... 248/461; 248/456

[58] Field of Search ..... 248/460, 461, 248/462, 150, 152, 423, 371, 393; 108/6, 10, 147, 90; 312/312, 231, 316

[56] References Cited

U.S. PATENT DOCUMENTS

| | | | |
|---|---|---|---|
| 369,124 | 8/1887 | Powers | 108/10 |
| 1,735,292 | 11/1929 | Moratz | 248/454 |
| 1,812,694 | 6/1931 | Hallowell | 312/281 |
| 1,942,340 | 1/1934 | Madden | 248/456 |
| 4,196,674 | 4/1980 | Van Laarhoven | 108/4 |
| 4,576,424 | 3/1986 | Nelson | 312/231 |
| 5,129,611 | 7/1992 | Grover et al. | 248/688 |
| 5,450,800 | 9/1995 | Leonard | 108/7 |
| 5,461,974 | 10/1995 | Reneau | 108/147 |
| 5,489,938 | 2/1996 | Maruyama | 348/15 |
| 5,590,864 | 1/1997 | Menard | 248/454 |
| 5,660,117 | 8/1997 | Noble | 108/35 |
| 5,690,310 | 11/1997 | Brown | 248/449 |
| 5,884,882 | 3/1999 | Nada | 248/188.2 |

*Primary Examiner*—Ramon O. Ramirez
*Assistant Examiner*—Gwendolyn Baxter
*Attorney, Agent, or Firm*—Daryl W. Schnurr

[57] ABSTRACT

A portable, collapsible work support is suitable for use as a desk, table, drafting table, projections table, lectern, trolley, flip chart holder, easel, white board, tack-board stand, notice board, work support in carpentry and other types of work support. The work support has an inner shell that is slideable within an outer shell and releasably lockable in various positions to achieve different heights. A support top can be moved and releasably locked in various positions from horizontal to vertical. A table top can be removably affixed to the support top when a larger work surface is desired. The table top can be folded and stored in the case that results when the work support is collapsed into a case. The work support has wheels to make it mobile.

9 Claims, 8 Drawing Sheets

COLLAPSIBLE PORTABLE WORK SUPPORT

BACKGROUND OF THE INVENTION

1. Field of Invention

This invention relates to a portable collapsible work support that is suitable for use as a desk, table, drafting table, projection table, lectern, trolley, flip chart holder, easel, white board, tack-board stand, notice board, other types of work support and the like.

2. Description of the Prior Art

Height adjustable podiums of the type described in U.S. Pat. No. 4,784,382 are known. The top is simply hinged to the rear side of the unit and can be rotated about the hinges to permit access to the interior of the podium. The rest position of the top is slanted toward a user of the podium and there is no suggestion that the top can be expanded to provide a larger surface. The podium is also not versatile and cannot be used, for example, as a desk or projection table.

SUMMARY OF THE INVENTION

A portable collapsible work support has an outer shell and an inner shell. The inner shell is slidable within the outer shell with locking means to releasably lock the shells in a fixed position relative to one another. In a collapsed position, the work support has a shape of a rectangular case with transport means at one lower end and a handle at a diagonally opposed position to said transport means. The case has a front, rear, two sides, a support top and bottom. The support top is in a closed position and the case contains accessories. In an extended position, the support top is in an open position, the inner shell is extended relative to the outer shell and is releasably locked in the extended position. The support top is connected to the shell of the inner and outer shell that is higher when the work support is in an upright extended position by adjustment means that permit said support top to move through a range of movement from a horizontal position to a vertical position. The support top pivots relative to the shell to which the support top is connected and is lockable successively in a fixed position relative to the shell at several points in the range including the horizontal position and the vertical position.

DESCRIPTION OF A PREFERRED EMBODIMENT

Figure 1:
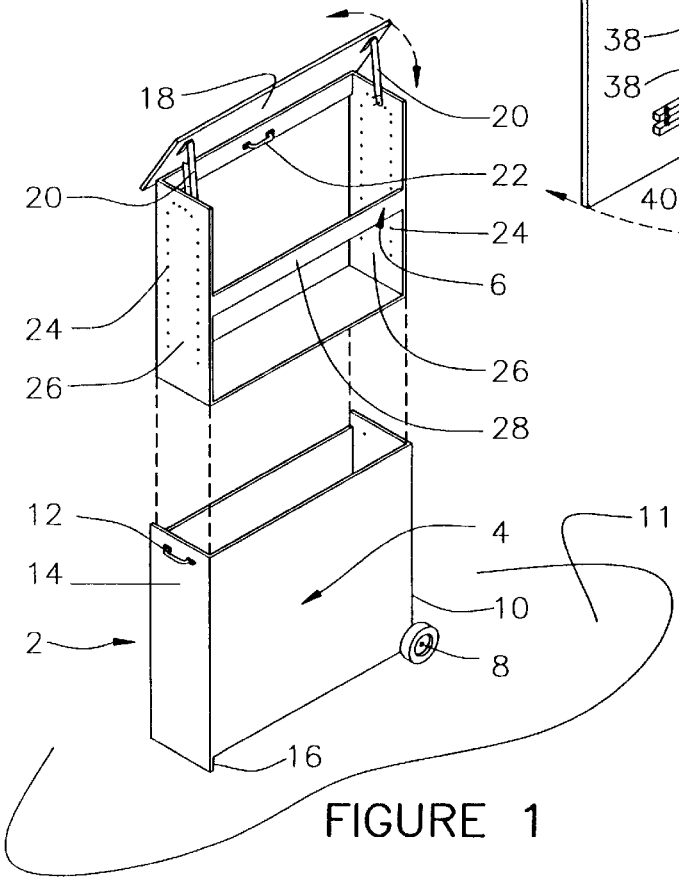
FIG. 1 is an exploded perspective view of the work support.

In FIG. 1 there is shown a perspective view of a portable, collapsible work support 2 comprising an outer shell 4 and an inner shell 6. The inner shell is slidable within the outer shell with locking means (best shown in FIGS. 4 and 7) to releasably lock said shells in a fixed position relative to one another. The outer shell 4 has wheels 8 (only one of which is shown) at an end 10. The wheels 8 rest on a supporting surface 11. A handle 12 is diagonally opposed to the wheels 8 and is located at an end 14.

Also at the end 14 of the outer shell 4, there is located a flange 16 so that both ends 10, 14 are the same distance above the supporting surface 11. The inner shell 6 has a support top 18 connected thereto by hinged extenders 20 and hinges (not shown in FIG. 1). The support top 18 is shown in an open position and a handle 22 is located inside of said inner shell 6 to enable the inner shell 6 to be extended upward relative to the outer shell 4. The inner shell 6 has a plurality of openings 24 on each of two ends 26. A rear wall of the inner shell 6, except for one board 28, is open to allow easy access to accessories (not shown in FIG. 1) within the inner shell 6.

Figure 2:
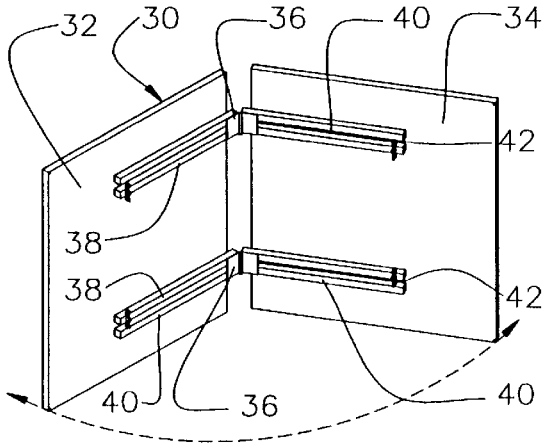
FIG. 2 is a perspective view of a table top in a partially folded position.

In FIG. 2, there is shown a foldable table top 30 having two flat sections 32, 34 connected by hinges 36. The table top 30 has four parallel ridges being two inner ridges 38 and two outer ridges 40. Each pair of inner and outer ridges 38, 40 is separated by a gap 42.

Figure 3:
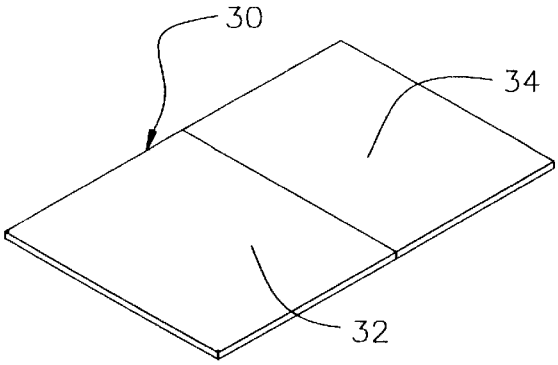
FIG. 3 is a perspective view of the table top in a flat position.

As can be seen from FIG. 3, the table top 30 can be made to lie flat so that both sections 32, 34 are in the same plane.

Figure 4:
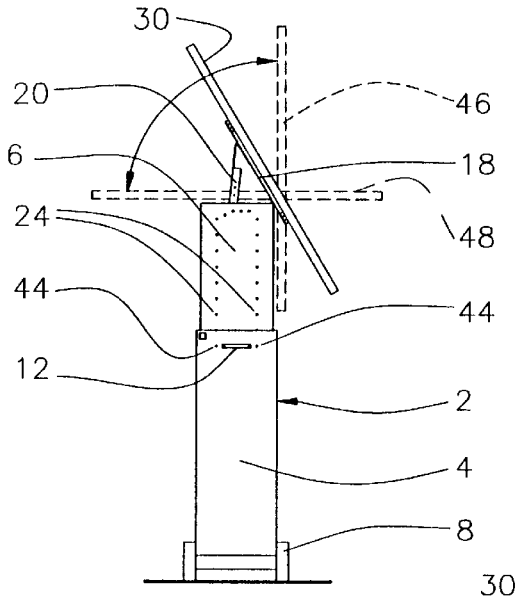
FIG. 4 is a side view of the work support with the table top mounted on a support top and the work support in an extended position.

In FIG. 4, there is shown a side view of the work support 2. The same reference numerals are used in FIG. 4 to describe those components of the work support 2 that are identical to the components shown in FIG. 1 without further description. The inner shell 6 is shown in an extended position relative to the outer shell 4. On either side of the handle 12, there is located two tiny holes 44 that align with two of the openings 24 in the inner shell 6 to hold the two shells in a fixed position relative to one another when a pin (not shown in FIG. 4) is inserted through the holes 44, 24 that are aligned with one another. The table top 30 is mounted on to the support top 18 and the range of movement of the tops 18, 30 is shown by the dotted lines from a vertical position 46 to a horizontal position 48.

Figure 5:
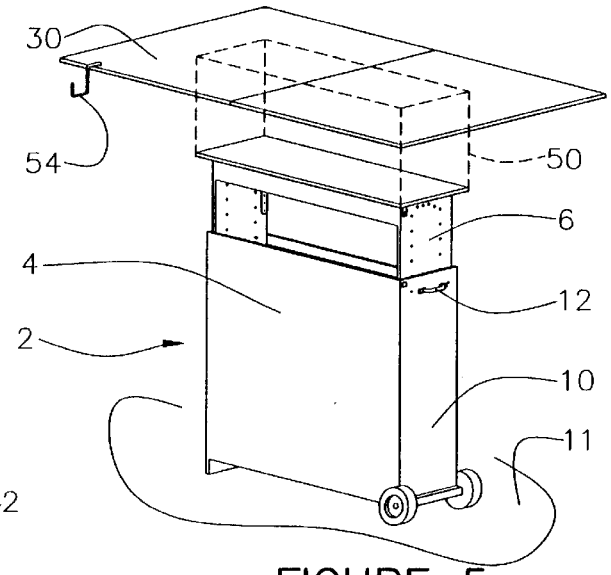
FIG. 5 is a perspective view of the work support in an extended position with the table top mounted on the support top.

In FIG. 5, there is shown a perspective view of the work support 2 in an extended position with the table top 30 supported in a horizontal position. Dotted lines 50 show the upper range of movement of the inner shell 6 relative to the outer shell 4. A handle 12 is located at the end 10 so that the work support 2 can be picked up, where required. The same reference numerals are used in FIG. 5 to describe those components that are identical to those of FIGS. 1 and 4 without further description. A hook 54 is mounted in a suitable opening (not shown) in the table top 30 and can be used to store various items, such as a user's coat or jacket (not shown).

Figure 6:
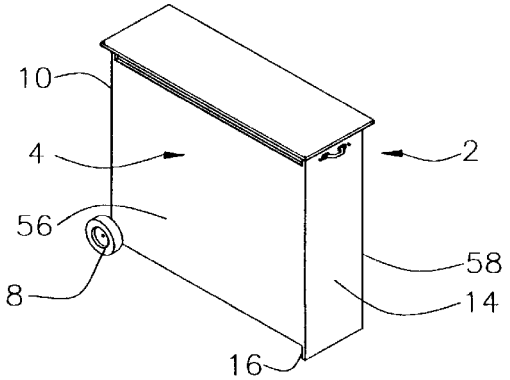
FIG. 6 is a perspective view of the work support in the form of a case.

In FIG. 6, the device 2 is shown in a collapsed position and has a shape of a rectangular case 54, a front 56, rear 58 and two ends 10, 14 (only one of which is shown). The same reference numerals are used to describe those components of FIG. 6 that are identical to the components of FIGS. 1, 4 and 5 without further discussion. The work support 2 is in a closed or collapsed position in FIG. 6.

Figure 7:
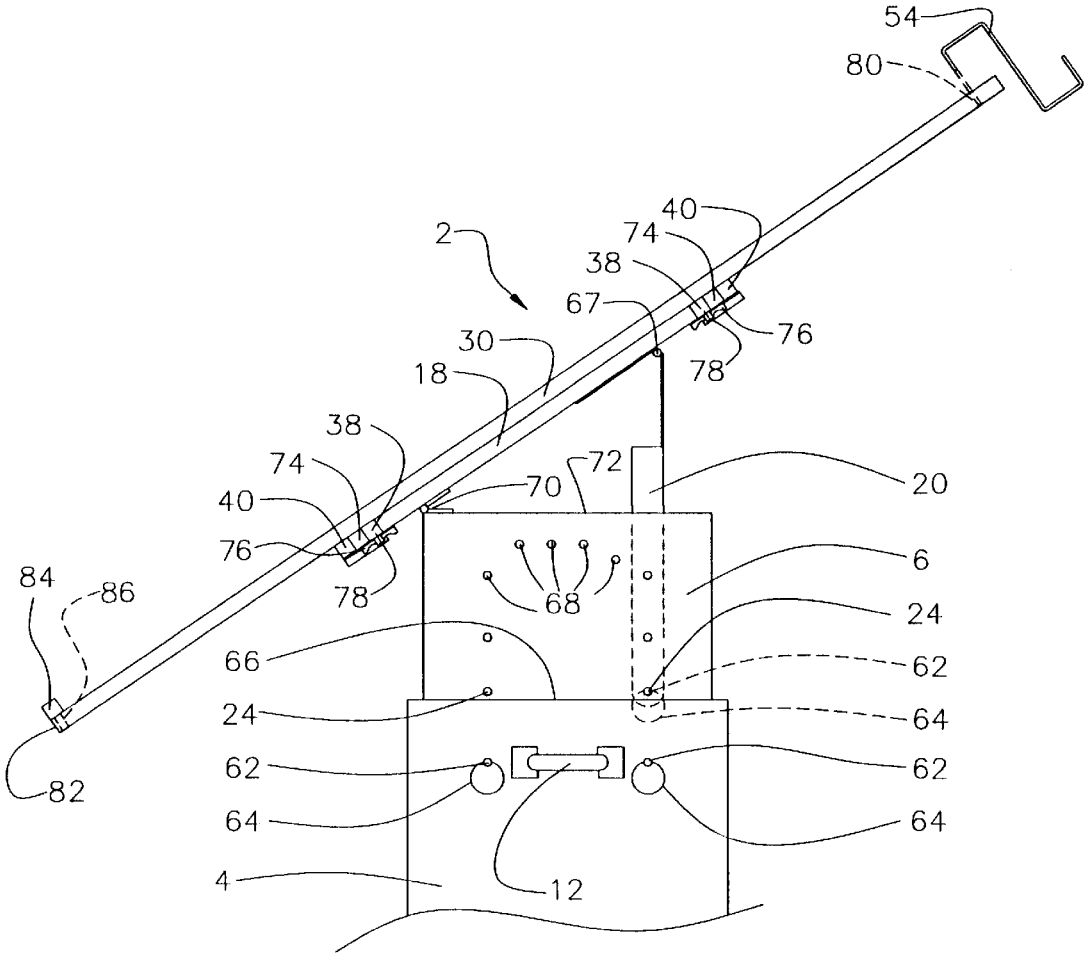
FIG. 7 is a partial side view of the work support with the table top mounted on the open support top.

In FIG. 7, the same reference numerals are used to describe the work support 2 as those used for FIGS. 1 to 6 for those components that are identical. The work support 2 is only partially shown and the outer shell 4 has two pins 62 containing rings 64 extending into openings 44 (not shown in FIG. 7) in the outer shell 4. From the two tiny openings 24 located immediately above an upper edge 66 of the outer shell 4 the openings in the inner shell 6 can easily be aligned with the openings in the outer shell 4 simply by inserting a pin into one of the openings that lies just above the edge 66 when the work support is nearly at an appropriate height. The inner shell can then be dropped down until the pin 62 rests on the upper edge 66. Then, another pin 62 can be inserted into the aligned openings.

The hinged extenders 20 have a hinge 67 and are preferably long enough at the slope of the table 30 shown so that the pin 62 on a right hand side of FIG. 7 extends into one of the openings 24, and an opening (not shown) in the hinged extender 20 to hold the table top 30 in the position shown. The pin 62 and ring 64 are dotted or the pin is inserted into the openings from the inside. A series of openings 68 is located to receive a lower end of the hinged extender 20 so that the table top 30 can be supported through a wide range of angles from the horizontal to the vertical. It can be seen that there is a piano hinge 70 between the support top 18 and an upper edge 72 of the inner shell 6. The inner ridges 38 are just wide enough to straddle upper and lower edges (not shown) of the support table 18. Reinforcing rods 74 fill what would otherwise be a space between the inner ridges 38 and the outer ridges 40 respectively. The reinforcing rods 74 are held in place by a latch 76 that is pivoted at point 78. The hook 54 is sized to be inserted into an opening 80 within the table top 30. Along a lower edge 82 of the table top 30 there is located a removable ledge 84 having a pin 86 extending into corresponding openings (not shown) in the table top 30.

Figure 8:
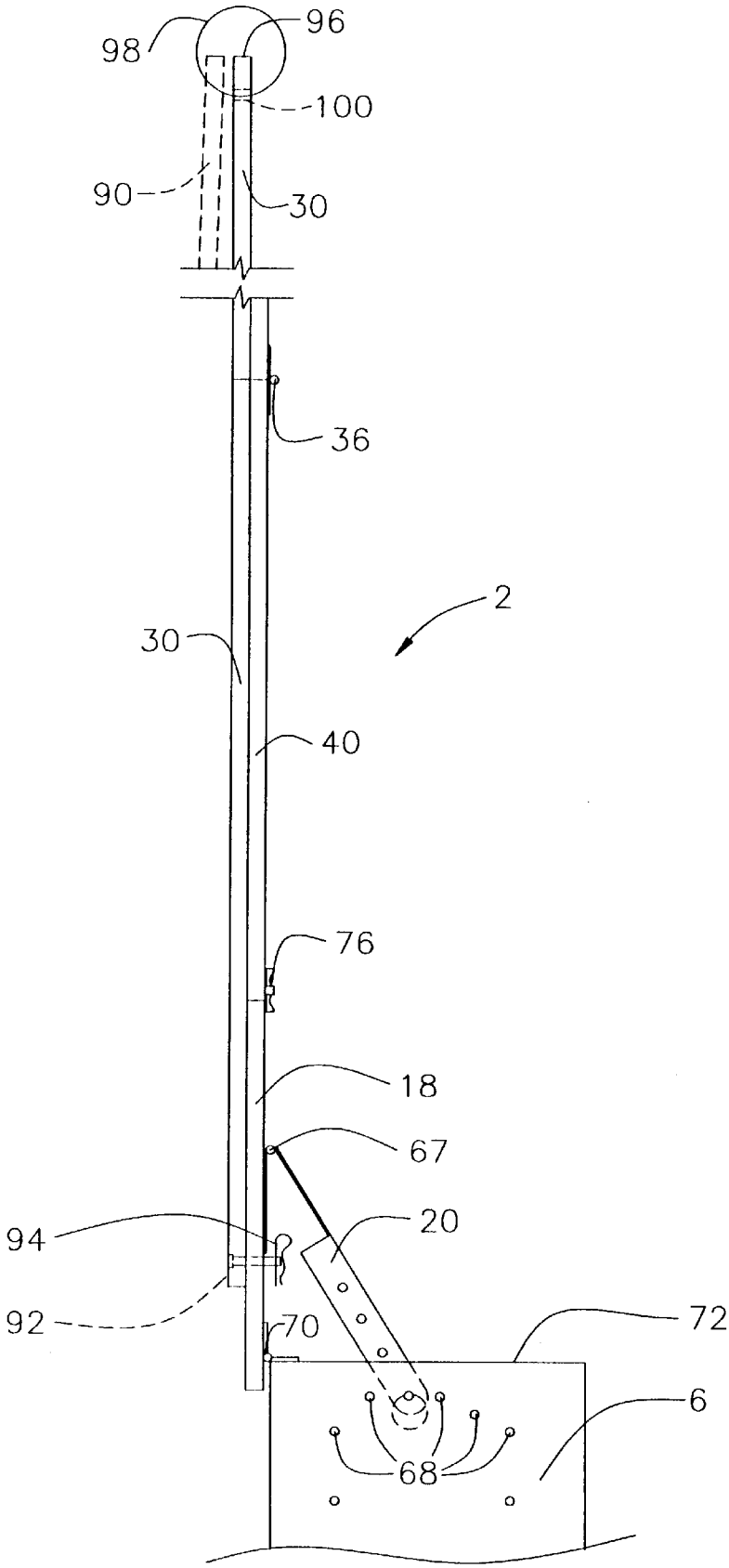
FIG. 8 is a partial side view of the work support with the table top held in a substantially vertical position.

In FIG. 8, the work support 2 is used as a flip chart 90 (partially shown) with the support top 18 rotated to a substantially vertical position by the relocation of the hinged extender 20 to an opening 68 (not shown in FIG. 8) in the upper center of the inner shell 6. For ease of illustration, the lower part of the inner shell 6 and the entire outer shell 4 have been omitted from FIG. 8. The same reference numerals are used in FIG. 8 for those components of the previous Figures that are identical to those of FIG. 8 without further description. The support top 18 has a suitable opening (not shown) therein to receive a bolt 92 which is held in place by a cotter pin 94. The table top 30 is rotated 90° from the position shown in FIG. 7 relative to the support top 18 and the pivotal latches 76 (only one of which is shown in FIG. 8) together with the bolt 92 and cotter pin 94 hold the table top 30 in the substantially vertical position shown. While they cannot be seen in FIG. 8, the reinforcing bars 74 extend between the inner and outer ridges 38, 40 so that both sections 32, 34 of the table top 30 (best seen in FIG. 10) remain in the same plane despite the presence of the hinges 36 (only one of which is shown). The flip chart 90 can be connected to an upper edge 96 of the table top 30 in the orientation shown in FIG. 8 in a conventional manner and the flip chart can be used in a conventional manner with rings 98 (only one of which is shown in FIG. 8) extending through an opening 100 in the table top 30.

Figure 9:
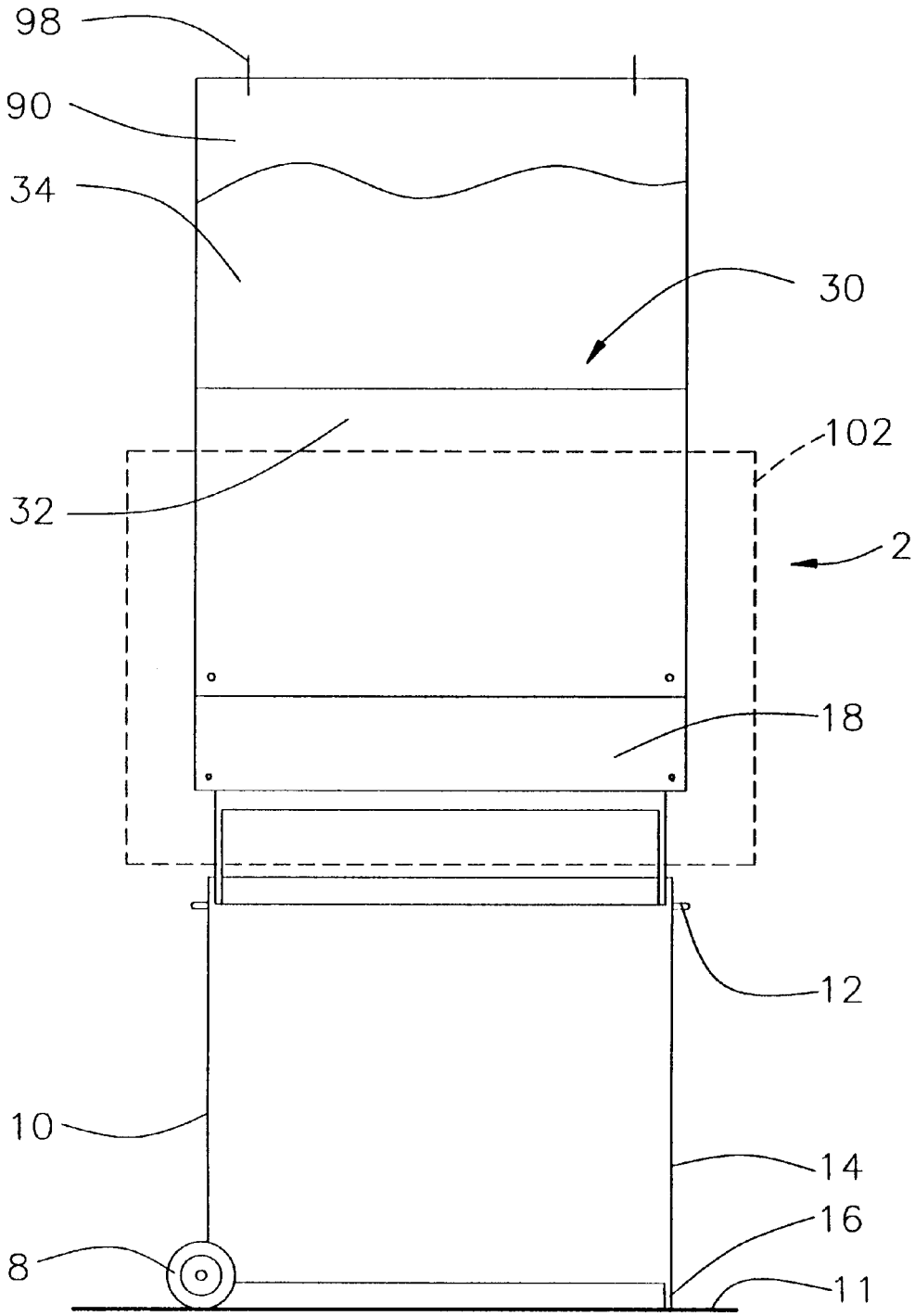
FIG. 9 is a front view of the work support with the table top in substantially vertical position and the device being used as a flip chart holder.

In FIG. 9, there is shown a schematic front view of the work support 2 when used as a flip chart in the position shown in FIG. 8. The same reference numerals are used in FIG. 9 as those used in the previous Figures for those components that are identical without further description. A dotted line rectangle 102 shows an alternative orientation for the table top 30 when in the same substantially vertical position as that shown in FIG. 8, but the table top 30 remains in the orientation relative to the support top 18 (not shown in FIG. 9) shown in FIG. 7. The flip chart 90 has been cut off to expose the table top 30.

Figure 10:
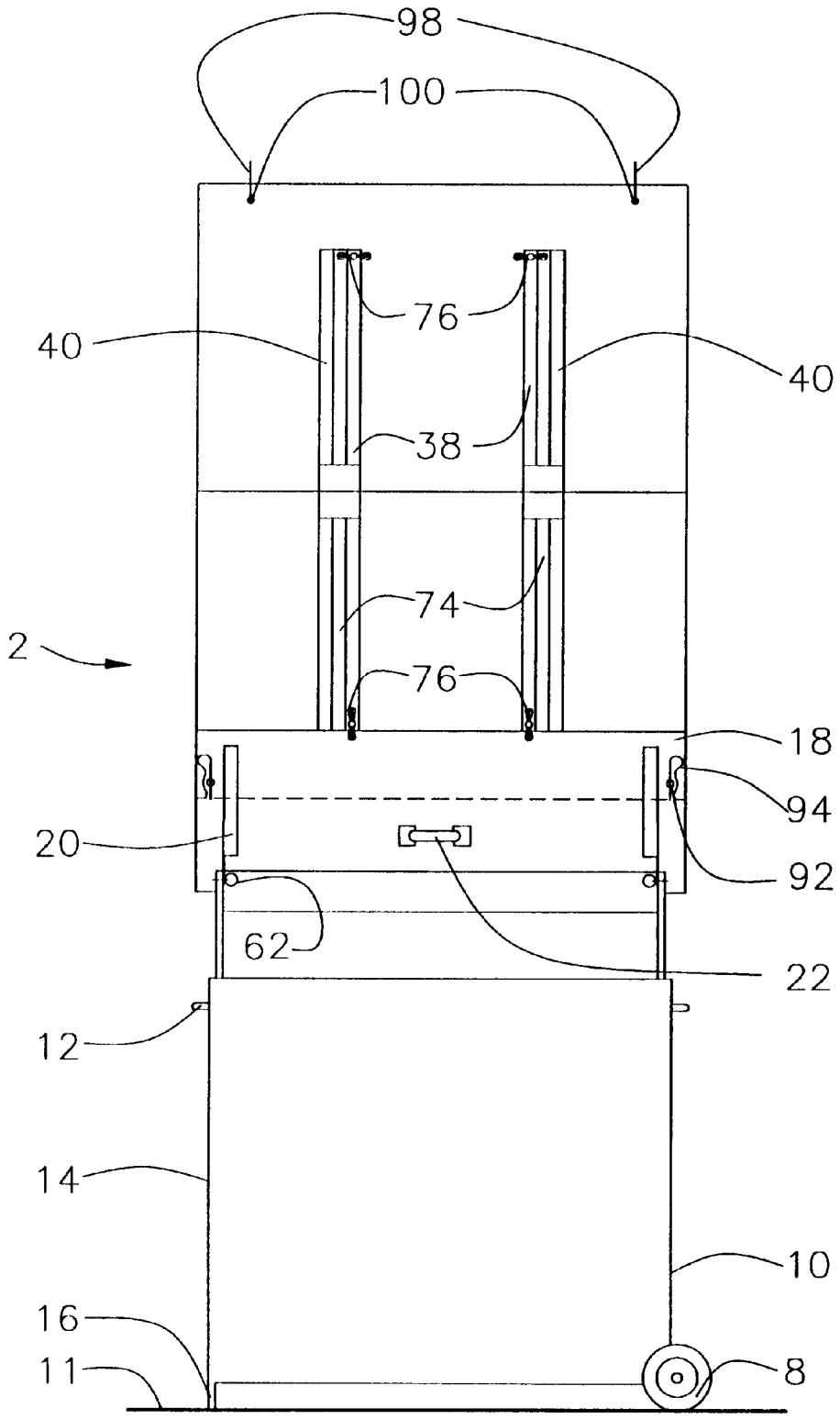
FIG. 10 is schematic rear view of the work support when used as a flip chart.

FIG. 10 is a schematic rear view of the work support 2 when used as a flip chart as shown in FIG. 8. The same reference numerals are used in FIG. 10 to describe those components that are identical to the components of the previous Figures.

Figure 11:
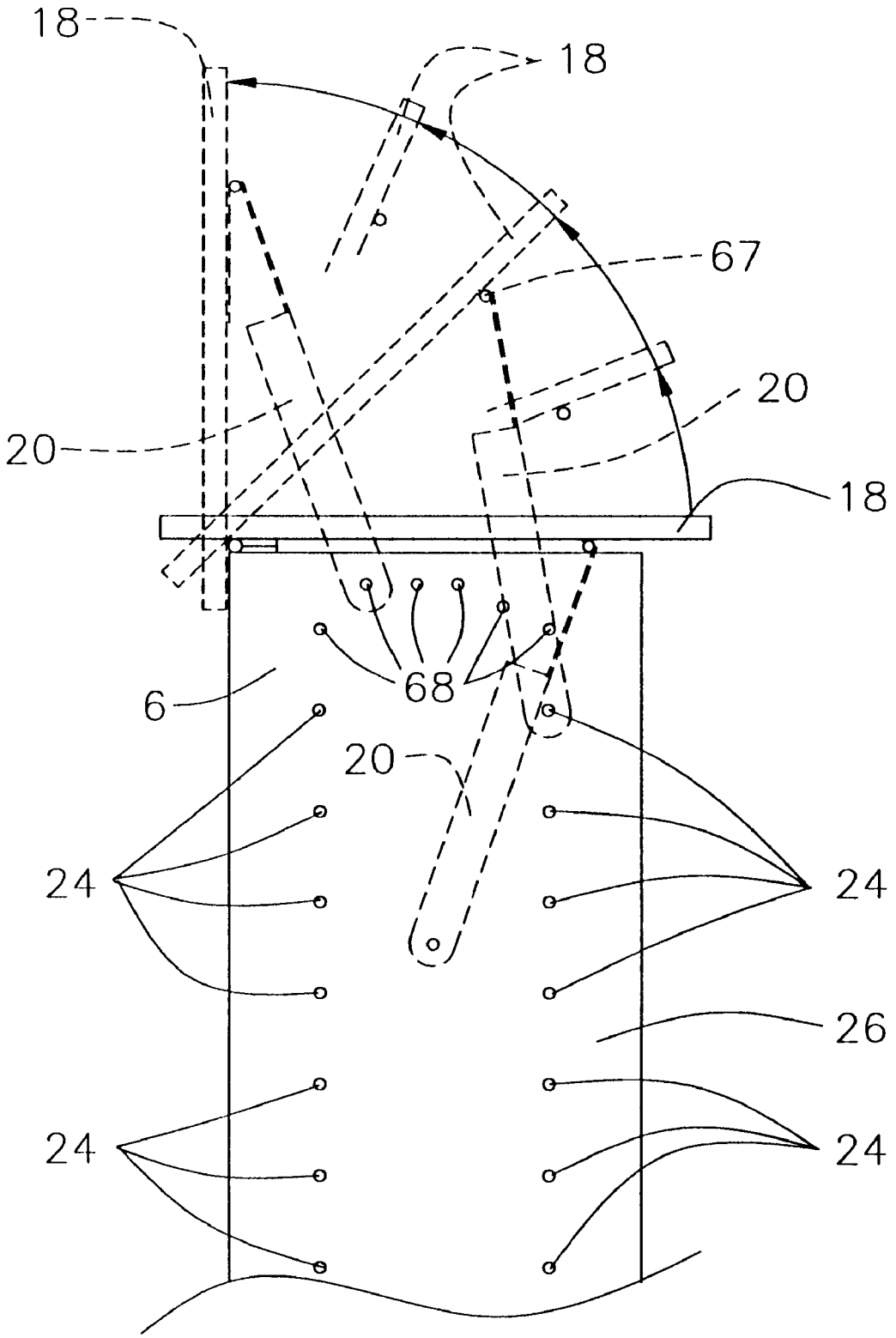
FIG. 11 is a partial side view of the work support with the support top in a range of positions from a horizontal position to a vertical position.

FIG. 11 is a schematic side view of an upper portion of the inner shell 6 and the movement of the support top 18 through various positions shown by dotted lines as the hinged extenders 20 are positioned using pins (not shown) in the various openings 68, 24 in the side 26 of the inner shell 6.

Figure 12:
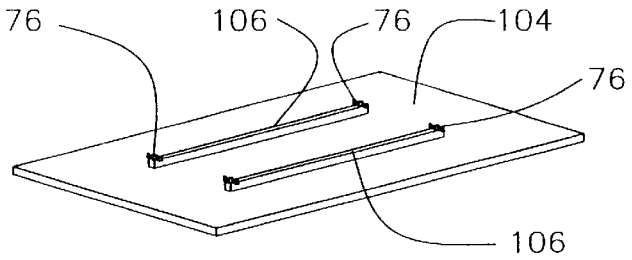
FIG. 12 is perspective view of a one piece table top facing down.

FIG. 12 is a perspective view of a one piece table top 104. The table top 104 will not fit within the case when the work support is in the collapsed position shown in FIG. 6, but users may find a one piece table top to be more convenient where the work support is being used mainly at one site and there is room to store the table top 104 outside of the case. The table top 104 has inner ridges 106 that are located in the same place as the inner ridges 38 in the foldable table top 30 so that the table top 104 can be affixed to the support top 18 in the same manner except that the reinforcing bars 74 and outer ridges corresponding to outer ridges 40 are not required. The ridges 106 have pivotal latches 76 thereon.

Figure 13:
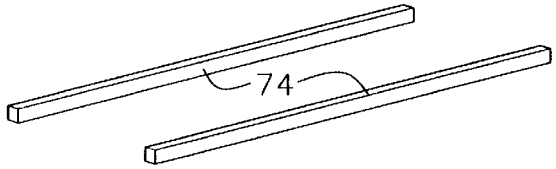
FIG. 13 is a perspective view of two reinforcing rods.

In FIG. 13, there is shown a perspective view of the reinforcing bars 74.

Figure 14:
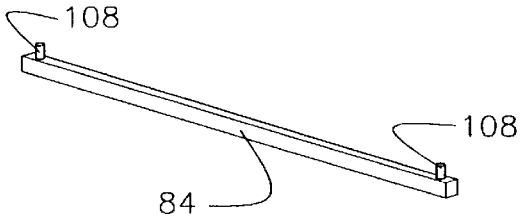
FIG. 14 is perspective view of a removable edge facing down.

In FIG. 14, there is shown a perspective view of the ledge 84 having pins 108 which are sized to be inserted in the openings 86 (not shown in FIG. 14).

Figure 15:
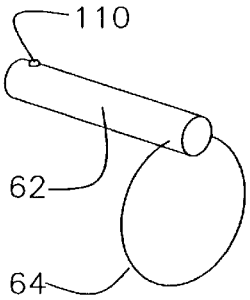
FIG. 15 is a perspective view of a removable pin.

In FIG. 15, there is shown a perspective view of one of the pins 62 having a ring 64. Preferably, the pin 62 has a spring loaded nodule 110 to prevent the pin from accidentally slipping out of the opening (not shown in FIG. 15) into which it has been inserted. The same pins 62 or a shorter version can be used in the openings 68.

Figure 16:
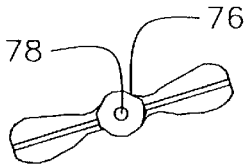
FIG. 16 is a perspective view of a pivotal latch.

In FIG. 16, there is shown a perspective view of the pivotal latch 76 and the pivotal point 78.

Figure 17:
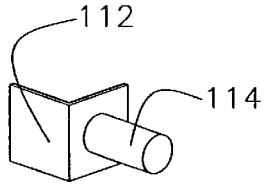
FIG. 17 is a perspective view of a clip.
Figure 18:
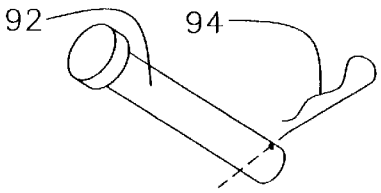
FIG. 18 is an exploded perspective view of a bolt and cotter pin.

In FIG. 17, there is shown a perspective view of a variation in the ledge 84. A clip 112 has pins 114 for insertion into the openings 86 (not shown in FIG. 17) In FIG. 18, there is shown an enlarged perspective view of the bolt 92 and cotter pin 94.

The work support can be manufactured of various materials including wood, plastic, plastic laminate, aluminum, or other materials. The work support is sized so that it will fit into most car trunks when collapsed. In addition, to holding accessories for the work support the case can be used to store and transport drawings, text charts or other items that are used with or made by using the work support. Other tops (other than the table top) can also be designed to fit on the support top. For example, the work support could be used as an ironing board that fits onto the support top. One or more work supports could be used to support a top or tops for a ping pong table. Other uses within the scope of the attached claims beyond those specified in this Application can be made of the work support.

What is claimed is:

1. A portable, collapsible work support comprising an outer shell and an inner shell, said inner shell being slidable within said outer shell with locking means to releasably lock said shells in a fixed position relative to one another, in a collapsed position:

said work support having a shape of a rectangular case with transport means at one lower end and a handle at a diagonally opposed position to said transport means, said case having a front, rear, two sides, a support top and bottom, said support top being in a closed position, said case containing accessories;

an extended position:

said support top being in an open position, said inner shell being extended upwardly relative to said outer shell and being releasably locked in said extended position, said support top being connected to said inner shell when said work support is in an upright and extended position by adjustment means that permit said support top to move through a range of movement from a horizontal position to a vertical position, said support top pivoting relative to said inner shell and being lockable successively in a fixed position relative to said inner shells at several points in said range including said horizontal position and said vertical position, one of said accessories having two large flat surface that are hinged to one another to form a table top with connecting means to releasably connect said table top to said support top.

2. The work support as claimed in claim 1 wherein said adjustment means are hinges along one edge of said support top top connect said support top to said inner shell and hinged extenders connected to said support to apart from said hinges, said extenders having a base section that is movable and securable in various positions to move said support top between said horizontal position and said vertical position.

3. The work support as claimed in claim 1 wherein said connecting means for said table top are two parallel ridges that are spaced apart from one another by a distance that is slightly greater than a width of said support top, said table top resting on said support top so that said support top fits in between said ridges with retention means on said ridges to retain said table top in position on said support top.

4. The work support as claimed in claim 3 wherein said inner and outer shells have a series of tiny openings therein that can be aligned with one another for receiving a pin to hold said shells in a fixed position.

5. The work support as claimed in claim 4 wherein there are four parallel ridges in total on said table top, two inner ridges and two outer ridges, said inner ridges being spaced apart by a distance that is equal to a width of said table top, said inner and outer ridges being spaced apart by a sufficient distance to receive a reinforcement for said table top with retention means to hold said reinforcement in position.

6. The work support as claimed in claim 5 wherein said table top has a raised ledge along one side.

7. The work surface as claimed in claim 1 wherein said adjustment means is comprised of two separate and distinct adjustment means with a series of openings in said base section, said openings being sized to receive a pin that extends through said openings and said adjustment means and a plurality of openings in said inner shell to change an angle of orientation of said support top.

8. The work support as claimed in claim 1 wherein said transport means are wheels.

9. The work support as claimed in claim 1 wherein there are tiny openings in the inner and outer shell are spaced so that the tiny openings are aligned when a pin through one of the openings in the inner shell rests on an upper edge of the outer shell.

* * * * *